United States Patent [19]

Kelly, Jr.

[11] 4,209,381

[45] Jun. 24, 1980

[54] METHOD AND APPARATUS FOR TREATING DRILL CUTTINGS AT AN ONSITE LOCATION

[75] Inventor: John Kelly, Jr., Arlington, Tex.

[73] Assignee: Mobil Oil Corporation, New York, N.Y.

[21] Appl. No.: 874,713

[22] Filed: Feb. 2, 1978

[51] Int. Cl.[2] ..... C10G 1/00; C09K 7/00; E21B 21/00; F26B 7/00

[52] U.S. Cl. ..... 208/8 LE; 208/11 LE; 175/66; 175/206; 34/13; 34/73

[58] Field of Search ..... 34/13, 73; 208/8, 11 LE; 175/66, 206

[56] References Cited

U.S. PATENT DOCUMENTS

| | | | |
|---|---|---|---|
| 1,580,723 | 4/1926 | Hapgood | 134/10 |
| 3,381,390 | 5/1968 | Long | 34/73 |
| 3,567,622 | 3/1971 | Waltrip | 208/8 X |
| 3,751,358 | 8/1973 | Elliott | 208/11 LE |
| 3,875,046 | 4/1975 | Rosenbloom | 208/11 LE |

*Primary Examiner*—Delbert E. Gantz
*Assistant Examiner*—William G. Wright
*Attorney, Agent, or Firm*—C. A. Huggett; Drude Faulconer

[57] ABSTRACT

An onsite method and apparatus for treating oil-contaminated drill cuttings at an onsite location, e.g., offshore drillsite, whereby the cuttings can be disposed of directly without the risk of pollution. The contaminated cuttings are separated from the drilling mud and are passed to a heating section of a treating unit where they are sprayed with steam to flash distill the oil from the cuttings. The distilled oil and the spent steam are passed to a cooling section of the treating unit where they are condensed before being passed to a water-oil separator. The cleaned cuttings are removed from the heating section for disposal, e.g., by dumping them into the water if at an offshore location.

7 Claims, 6 Drawing Figures

EXHAUST
WATER
OIL

WATER
OIL
44
48
45
46
47
43
42
40
27b
134a
132a
134
132
130a
132b
130
25
60
131
151
133a
133
127a
127
126
128
44a
45a
45b

METHOD AND APPARATUS FOR TREATING DRILL CUTTINGS AT AN ONSITE LOCATION

BACKGROUND OF THE INVENTION

The present invention relates to an onsite method and apparatus for treating contaminated drill cuttings before disposal and more particularly relates to a method and means for removing oil or like contaminants from drill cuttings at a drilling site, e.g., an offshore location, before final disposition of the cuttings, e.g., dumping the cuttings into the water at an offshore site.

In a rotary drilling operation, a fluid commonly called "mud" is circulated from a storage area on the surface, downward through the drill pipe, out openings in the drill bit, and upward within the borehole to the surface. This return mud carries with it the drill cuttings from the bottom of the borehole. The returning mud along with its entrained drill cuttings is passed onto a "shale shaker" before it is returned to the storage area. The shaker, which normally sits above the mud storage area, is essentially a screen that is used to separate the drill cuttings and cavings from the mud. The mud falls by gravity through the screen and the cuttings pass over the end of the screen.

Disposal of these separated cuttings is sometimes a real problem, e.g., where the drilling operations are carried out at an offshore location. In some instances, the cuttings are passed from the shaker back into the water and are allowed to settle to the bottom. However, as is often the case, when a drilling mud system such as an oil-base mud is used which coats the cuttings with undesirable contaminants, e.g., oil, the cuttings cannot be disposed of directly into the water without the risk of polluting the area around the drilling site. Although the disposal of contaminated drill cuttings is complicated at an offshore location, it may also be a major problem at onshore locations where ecological considerations prevent the normal disposal of untreated cuttings.

There are two general techniques for treating these contaminated cuttings to make them ecologically acceptable. Either they must be hauled or barged to disposal facilities on shore or they must be treated on site to remove the contaminants before they are disposed of in the water. The added expense involved in hauling the cuttings ashore is substantial, and, accordingly, seriously detracts from widespread commercial application of this technique. Further, the technique of hauling of the cuttings to shore for disposal may be impractical in areas of bad weather and rough seas. Therefore, for obvious reasons, it is much preferred to treat and dispose of the drill cuttings from offshore operations directly at the drilling site.

To treat contaminated cuttings onsite, at least two different types of methods have been proposed. One approach is to burn oil off the cuttings with high intensity lamps. However, this approach presents problems (i.e., possible fire hazards due to the lamps and the difficulty of equally exposing all the cuttings to the lamps) which makes it unfeasible in most instances.

The second approach involved washing the cuttings with a detergent to remove the contaminants, separating the washing solution and contaminants, and dumping the cleaned cuttings into the water. One example of this approach is disclosed in U.S. Pat. No. 3,688,781, issued Sept. 5, 1972. Other wash techniques are discussed in the article "Cuttings Can Meet Offshore Environment Specifications", OIL AND GAS JOURNAL, Aug. 14, 1972, pp. 73–76. While such techniques may be successful in cleaning the cuttings, there still exists a possibility that some pollution may result if the detergent, itself, is not properly handled.

SUMMARY OF THE INVENTION

The present invention provides a method and apparatus for treating drill cuttings at an onsite location to remove contaminants such as oil from the cuttings before disposal of the cuttings.

In accordance with the present invention, a treating unit is located onsite and is adapted to receive contaminated drill cuttings after they have been separated from the mud. The treating unit is comprised of a conveyor means which receives the contaminated cuttings and carries them through a heating section of the treating unit. Positioned within the heating section are steam jets which spray the cuttings to heat the cuttings to a temperature of at least 212° F. and preferably to a temperature of 300° F. or more.

The steaming causes a steam distillation of the oil on the cuttings to take place. The steam and the oil, now entrapped in the steam, are withdrawn by means of a vacuum exhaust fan, or the like from the heating section and are passed to a cooling section of the treating unit where they are condensed. The condensed liquids are then removed from the cooling section and flow to a separation section in which the oil is separated from the water. The cuttings, now free of contaminants, pass from the heating section and ready for disposal.

BRIEF DESCRIPTION OF THE DRAWINGS

The actual construction, operation, and the apparent advantages of the invention will be better understood by referring to the drawings in which like numerals identify like parts and in which.

DESCRIPTION OF THE PREFERRED EMBODIMENT

Figures 1, 2, 3:
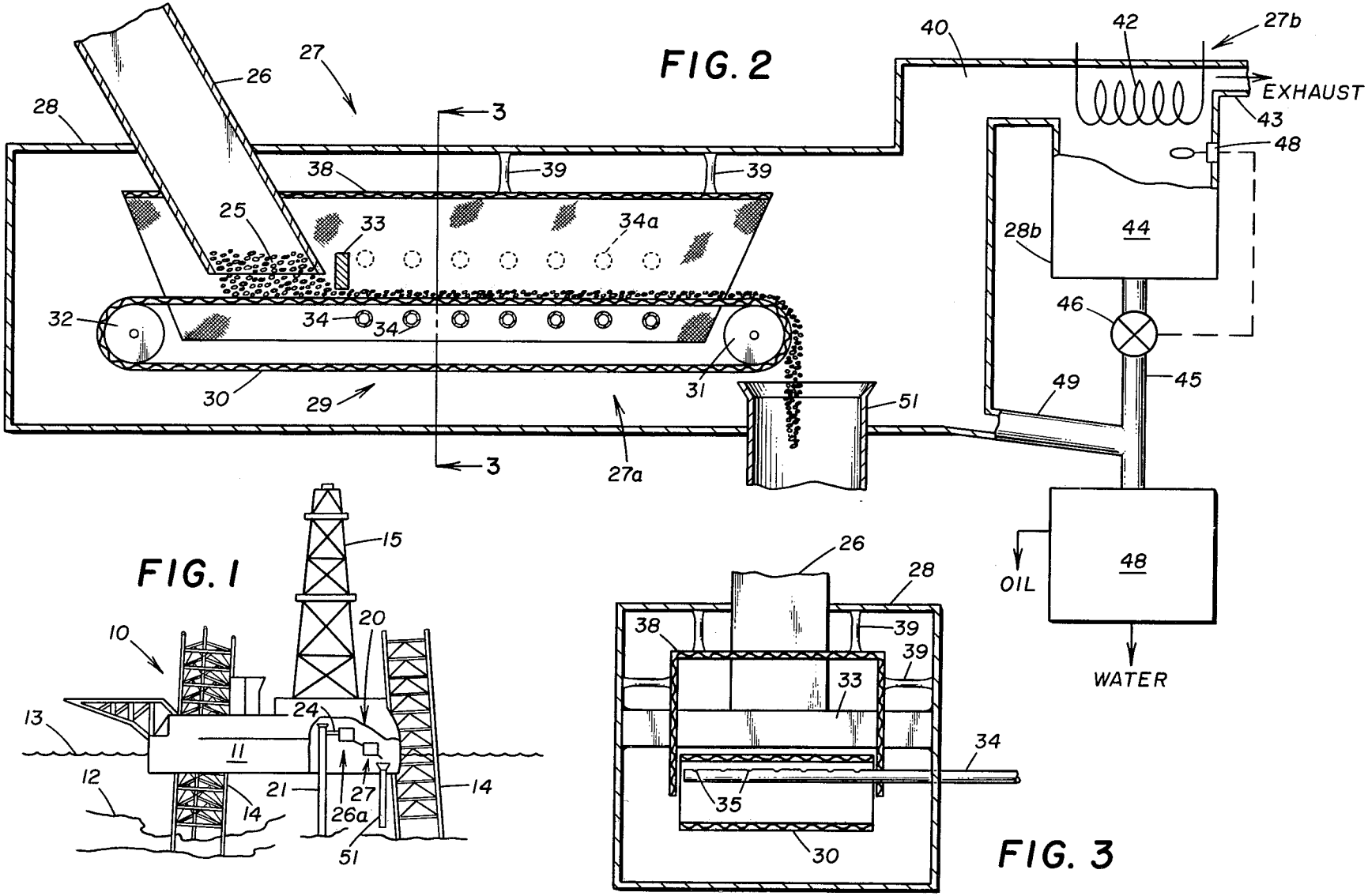
FIG. 1 is a perspective view, partly in section, of an offshore drilling platform incorporating the present invention.
FIG. 2 is a schematical, elevational view, partly in section, of a treating unit in accordance with the present invention.
FIG. 3 is a cross-sectional view taken along line 3—3 of FIG. 2.

Referring more particularly to the drawings, a typical offshore drilling rig 10 is disclosed in FIG. 1 which has a platform 11 supported on marine bottom 12 of the body of water 13 by means of legs 14. A derrick 15 is mounted on platform 11 which is used to carry out normal rotary drilling operations. Although a fixed platform is shown for illustrative purposes, it should be realized that the present invention can be used equally as well with other offshore drilling apparatus, e.g., floating drilling vessels, submergible barge platforms, etc. or it can be used at onshore locations.

In rotary drilling operations, a fluid commonly called mud is circulated into and out of the hole being drilled for a number of reasons, one being to carry drill cuttings out of the borehole. A typical, well known mud circulation system 20 for a rotary drilling operation is partially illustrated in FIG. 1. A conductor pipe 21 extends from platform 11 into marine bottom 12. Mud is circulated down a drill string (not shown) which is positioned in and extends through conductor pipe 21. The mud exits from the drill pipe through openings in a drill bit (not shown) on the lower end of the drill pipe and flows upward through conductor pipe 21 to mud return line 24. The mud carries drill cuttings with it back to the surface. As is well known in the art, the mud exits mud return line 24 and flows through shale shakers, desanders, desilters, hydrocyclones, centrifuges, and/or other known devices (shown collectively as 26*a* in FIG. 1) to separate the cuttings from the mud. The mud is then returned to a storage area (not shown) for reuse.

Where the mud being used does not coat the cuttings with any undesirable contaminants, the cuttings are sometimes returned directly to the body of water 13 or are disposed of in some other manner. However, as is often the case, a special mud system has to be employed in certain drilling operations, both offshore and onshore, which coats the cuttings with contaminants. This presents serious problems in disposing of the cuttings. For example, in offshore operations, the contaminants may wash free when the cuttings are returned to the water, thereby causing undesirable pollution problems. An example of such a mud system is one commonly called "oil-base" mud system. The mud used in this system coats the cuttings with oil which remains adhered thereto even after the cuttings are mechanically separated from the mud. If these cuttings are returned untreated to the water, some of the oil most likely will wash off and may form an oil slick on the water. Also, in some instances, the cuttings, after separation, are "washed" with diesel or other suitable oil to remove whole mud therefrom. However, some of the diesel or other oil is likely to adhere to the cuttings which complicates their disposal.

In the modification shown in FIGS. 2 and 3, contaminated cuttings 25, after being separated from the mud and/or washed with diesel or other suitable oil, pass through chute 26 or the like into treating unit 27 which is comprised of a heating section 27*a* and a cooling section 27*b*. Cuttings 25 are deposited onto a conveyor means 29 within housing 28 of treating unit 27. Conveyor means 29 is shown as a conveyor belt 30 mounted on a driving wheel 31 and an idler wheel 32, but it should be recognized that other known conveyor means (e.g., screw conveyor, rotating kiln type conveyor, etc.) could be used in place of the conveyor belt arrangement without departing from the present invention. As shown, skimmer bar 33 is attached to housing 28 and is spaced above belt 30 to level cuttings 25 on belt 30 as it moves under bar 33 so that a layer of cuttings having a substantially equal thickness is maintained on belt 30 as it moves through heating section 27*a*.

A plurality of pipes 34, each adapted to be connected to a steam source (not shown), are positioned within heating section 27*a*. Preferably, belt 30 is constructed of a fine mesh, screen-like material which will allow steam to pass therethrough but will prevent cuttings 25 from passing therethrough. Pipes 34 are perforated along their upper sides to form steam jets 35 (see FIG. 3) and are positioned below belt 30 as shown. For such an arrangement, see U.S. Pat. No. 2,576,283, issued Nov. 27, 1951. If belt 30 is constructed from an impervious material, pipes 34*a* (shown in dotted lines in FIG. 2) are perforated along their underside and positioned above belt 30. In some instances, both pipes 34 and 34*a* are used to increase the exposure of cuttings 25 to steam as will be explained later. Retainer 38 constructed of screen material substantially encloses belt 30 and is affixed to housing 28 by supports 39.

Duct 40 provides fluid communication between heating section 27*a* and cooling section 27*b*. Cooling section 27*b* includes cooling means, e.g. coil 42, positioned therein and is adapted to be connected to a vacuum source, exhaust fan, or the like (not shown) through line 43 to create fluid flow from heating section 27*a* through cooling section 27*b*. It should be recognized that other means, e.g. blowers in heating section 27*a* (not shown), could be used to induce flow from heating section 27*a* through cooling section 27*b* without departing from the present invention.

Housing 28*b* of cooling section 27*b* forms a collection section 44 below coil 42. Drain 45 having a solenoid-operated valve 46, controlled by float level switch 47, connects collection section 44 to oil-water separator means 48. Drain 49 connects the interior of housing 28 to separator means 48 for a purpose explained below. The apparatus having been explained, the operation thereof is as follows.

Oil contaminated cuttings 25 are separated from the mud by equipment 26*a* and are fed down chute 26 onto belt 30. Skimmer bar 33 levels cuttings 25 as they pass thereunder to evenly distribute the cuttings on belt 30. As cuttings 25 pass through heating section 27*a*, steam having a temperature of at least 212° F., preferably in excess of 300° F., is sprayed from jets 35 through the screen material of belt 30 and directly onto cuttings 25. If desired, the driving mechanism for belt 30 can include a mechanism (not shown) to impart vibrations to belt 30 for agitating cuttings 25 as they pass through heating section 27*a* to increase their exposure to the steam.

The steaming causes a steam distillation of the oil from the cuttings. For a good discussion of steam distillation, per se, see EXPERIMENTS IN ORGANIC CHEMISTRY, L. F. Fieser; 3rd Edition, Revised; D. C. Heath and Company, Boston; Chapter 8. Cuttings 25, now clean, are carried by belt 30 out of heating section 27*a* and drop off the end of belt into chute 51 which forms an exit from housing 28. Chute 51 conveys cuttings 25 to a disposal area, e.g. water 13 as shown in FIG. 1.

Spent steam and the distilled oil vapor are evacuated from heating section 27*a* through duct 40. Screen retainer 38 allows the steam and oil to pass therethrough but prevents any cuttings 25 stirred up by the live steam from jets 35 from being carried out of heating section 27*a*. Any such cuttings will hit retainer 38 and fall back onto belt 30. The spent steam and distilled oil will be pulled into cooling section 27*b* and across coil 42. A coolant is supplied through coil 42 to substantially lower the temperature in cooling section 27*b*. In some instances, a refrigerant, e.g. freon, propane, or the like, may be required as a coolant while in other instances, depending on geographical location, merely circulating ambient air or seawater may suffice. The cooling of the steam and oil causes condensation thereof and the resulting water and oil collects in collection section 44. Level switch 47 actuates valve 46 at the proper time to allow the water-oil mixture in collection section 44 to pass to separator means 48 through line 45. The oil and water can then be removed from separator means 48 after separation for reuse or disposal as desired. Any oil and steam that may condense on the walls of housing 28 within heating section 27a will accumulate in the bottom thereof and will flow to separator means 48 via drain 49.

Figures 4, 5, 6:
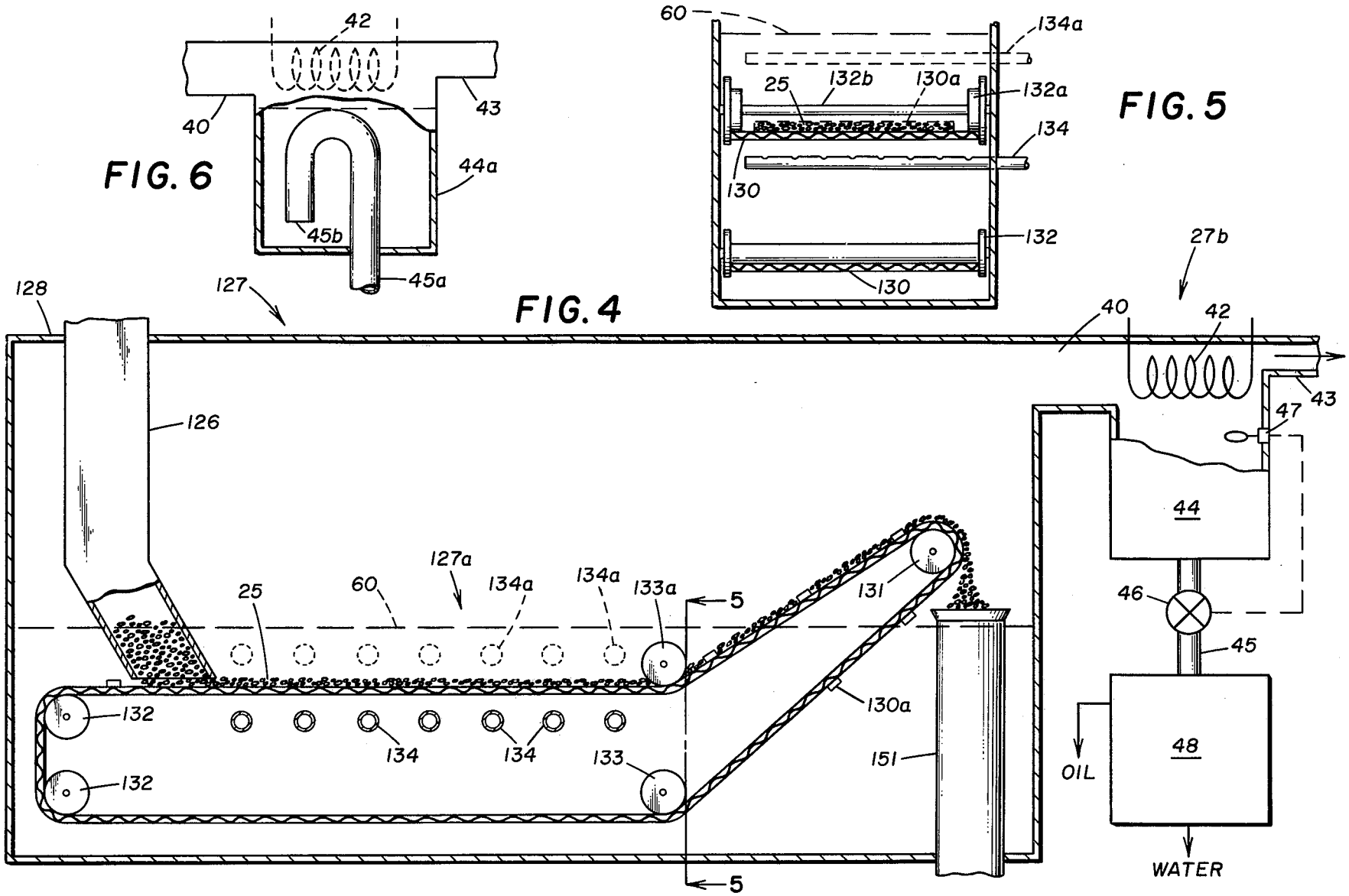
FIG. 4 is a schematical, elevational view, partly in section of a modification of a treating unit in accordance with the present invention.
FIG. 5 is a cross-sectional view taken along line 5—5 of FIG. 4.
FIG. 6 is an elevational view partly in section of a modified collection section of the present invention.

A modified collection section 44a is shown in FIG. 6 wherein drain 45a is used in place of drain 45, valve 46, and level control switch 47. Drain 45a is curved within collection section 44a so that liquid which collects within section 44a will enter drain 45a upwardly through opening 45b. It can be seen that as the liquid level within section 44a rises above the curve in drain 45a, the head of liquid will cause flow through drain 45a. This in effect provides an automatic level control.

A second modification of the treating unit is shown in FIGS. 4 and 5 and is basically the same as that shown in FIGS. 2 and 3 except it utilizes a boiling water bath as the contact media for steam distilling the oil from the cuttings 25. Treating unit 127 is comprised of heating section 127a and cooling section 27b. Cuttings 25 are deposited through chute 126 onto screen, conveyor belt 130 mounted on driving wheel 131 and idler wheels 132, 133, 133a.

Conveyor belt 130 is substantially horizontal along its length between idler wheels 132 and 133, 133a but then inclines upwardly along its length between idlers 133, 133a and driving wheel 131. The bottom of housing 128 is adapted to be filled with water to a level 60 (heavy dotted line in FIGS. 4 and 5) where the horizontal portion of belt 130 will be completely submerged. It will be seen in FIG. 5 that wheel 132a is constructed so that it will contact belt 130 only at the outer edges thereof with its axle 132b being spaced above belt 130 so cuttings 25 can easily pass thereunder. Also, if needed, pusher bars 130a (only a few shown in FIG. 4) can be attached at spaced intervals along belt 130 so that cuttings 25 will retain their position thereon during travel on the inclined portion of belt 130. As seen in FIG. 5, each bar 130a terminates inwardly of the outer edges of belt 130 so that the bars will easily pass by idler wheel 133a.

Pipes 134 adapted to be connected to a steam source (not shown) are positioned below belt 130 and within the water bath. Pipes 134a, shown in dotted lines, can also be used if needed. Duct 40 connects heating section 27b which is constructed and which operates in the same manner as in the modification shown in FIGS. 2 and 3.

The operation of treating unit 127 is as follows. Cuttings 25 are deposited onto belt 130 through chute 126 and are passed through the boiling water bath while steam is supplied to the water 60 through pipes 134 and/or 134a to heat same. The action of the steam causing the water bath to boil causes the oil on cuttings 25 to be distilled from the cuttings. The clean cuttings continue to be carried by belt 130 up its inclined portion, out of the water bath, and drop into chute 151 for disposal. In some instances it may be desirable to add a detergent to the water bath to aid in releasing the oil from the cuttings.

The distilled oil and water vapor flow from heating section 127a through duct 40 into cooling section 27b where it is condensed and collected in collection section 44. At the appropriate time, level switch 47 opens valve 46 so the condensed liquids flow from collection section 44 to separator means 48 through drain 45. The separated water and oil is then reused or disposed of as desired.

As seen from the above, the present invention provides a safe, reliable method for the onsite treatment of oil-contaminated drill cuttings which allow the cuttings to be disposed of without the risk of pollution.

What is claimed is:

1. A method of treating oil-contaminated drill cuttings from a well drilling operation to clean said drill cuttings at an onsite location, said method comprising:
- separating said drill cuttings from the drilling fluid used in said drilling operation;
- continuously passing said drill cuttings through a heating section;
- heating said drill cuttings while in said heating section with steam having a temperature greater than 212° F. to distill the oil from said drill cuttings thereby cleaning said drill cuttings;
- passing the distilled oil from the heating section to a cooling section;
- cooling said distilled oil while in said cooling section to condense said distilled oil; and
- disposing of said cleaned drill cuttings after they pass from said heating section.

2. The method of claim 1 wherein the step of heating said drill cuttings with steam comprises:
- spraying said steam directly onto said drill cuttings as they continuously pass through said heating section.

3. The method of claim 1 wherein the step of heating said drill cuttings with steam comprises:
- supplying said steam to a water bath in said heating section through which said drill cuttings continuously pass.

4. The method of claim 1 wherein said spent steam is passed along with the distilled oil to said cooling section to condense both the spent steam and the distilled oil.

5. The method of claim 4 including:
- separating said condensed steam and said condensed distilled oil.

6. Apparatus for treating oil-contaminated drill cuttings from a well drilling operation to clean said drill cuttings at an onsite location, said apparatus comprising:
- means for separating said drill cuttings from drilling fluid used in said well drilling operation;
- means for conveying said separated drill cuttings to a treating means, said treating means comprising:
  - a heating section;
  - a conveyor belt in said heating section adapted to receive said separated drill cuttings and carry said drill cuttings through said heating section;
- means in said heating section for spraying steam directly onto said drill cuttings as they are carried on said conveyor belt through said heating section to distill oil from said drill cuttings to thereby clean said cuttings;
- a cooling section;
- means for passing said distilled oil from said heating section to said cooling section;
- means in said cooling section for substantially reducing the temperature of said distilled oil to condense said oil; and
- means for disposing of said cleaned drilled cuttings after they have passed from said heating section.

7. The apparatus of claim 6 including:
- means in said heating section for substantially equally distributing said drill cuttings on said conveyor belt.

* * * * *